US007874339B2

(12) United States Patent
France et al.

(10) Patent No.: US 7,874,339 B2
(45) Date of Patent: Jan. 25, 2011

(54) APPARATUS FOR APPLYING INDICIA TO A CURVED SURFACE

(75) Inventors: Paul Amaat Raymond Gerard France, West Chester, OH (US); Robert Paul Cassoni, Dayton, OH (US); Christopher Lawrence Smith, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 969 days.

(21) Appl. No.: 11/580,593

(22) Filed: Oct. 13, 2006

(65) Prior Publication Data

US 2008/0087375 A1 Apr. 17, 2008

(51) Int. Cl.
*B65C 9/18* (2006.01)

(52) U.S. Cl. ..... 156/542; 156/556

(58) Field of Classification Search ..... 156/542, 156/556

See application file for complete search history.

(56) References Cited

U.S. PATENT DOCUMENTS

| | | | | |
|---|---|---|---|---|
| 2,684,775 | A * | 7/1954 | Von Hofe | 156/215 |
| 3,620,862 | A * | 11/1971 | Nier et al. | 156/69 |
| 5,117,993 | A | 6/1992 | Vesborg | |
| 5,879,496 | A * | 3/1999 | Bright et al. | 156/86 |
| 5,902,449 | A * | 5/1999 | Moore | 156/541 |
| 6,471,802 | B1 * | 10/2002 | Williamson | 156/64 |
| 6,796,352 | B1 | 9/2004 | Geurtsen et al. | |
| 2004/0123955 | A1 | 7/2004 | Kramer et al. | |

* cited by examiner

*Primary Examiner*—Khanh Nguyen
*Assistant Examiner*—Vishal I Patel
(74) *Attorney, Agent, or Firm*—Larry L. Huston; Leonard W. Lewis; Steven W. Miller

(57) ABSTRACT

A method and apparatus for applying indicia to a curved surface, including a compound curved surface having multiple axes of curvature. The curved surface is deformed to eliminate one axis of curvature. The invention is usable with hourglass or barrel shaped surfaces, as occur with containers, and to apply labels and other indicia to these surfaces.

6 Claims, 12 Drawing Sheets

APPARATUS FOR APPLYING INDICIA TO A CURVED SURFACE

FIELD OF THE INVENTION

The present invention relates to a method and apparatus for applying indicia to curved surfaces. The present invention may be used for applying labels to packaging.

BACKGROUND OF THE INVENTION

Indicia have been applied to curved surfaces in manners known in the art. For example, paint has been applied to car fenders, labels have been applied to cylindrical containers and instructions have been printed on or molded into camera bodies, as is known in the art.

Much of the art has been concerned with flat surfaces, such as flexible webs, including woven and nonwoven materials, and rigid surfaces, such as cardboard boxes or plastic as may be used for credit cards. Other art is concerned with surfaces curved in a single plane, such as a cylindrical container. Indicia may be applied to cylindrical containers using adhesive attachment, as may occur with a small prescription bottle or using a heat transfer label as may occur with a large bottle.

However, little attention has been paid to applying indicia to a compound curved surface. By compound curved, it is meant that the surface has curvature about two or more different axes. For example a barrel-shaped container has round (and closed) curvature about the longitudinal axis and convex (and open) curvature about a radial line perpendicular to the longitudinal axis. An hourglass-shaped container also has round (and closed) curvature about the longitudinal axis and concave (and open) curvature about a radial line perpendicular to the longitudinal axis. A sphere and a football have closed compound curvature about two orthogonal axes.

By closed it is meant that the periphery of the curvature forms a closed figure such as a circle, oval, ellipse, an irregular circumference subtending 360 degrees, etc. By open it is meant that the surface has two ends mutually spaced apart, as may occur with the top/bottom of a barrel or hourglass.

One attempt in the art to apply indicia to a curved surface is shown in U.S. Pat. No. 5,117,993. An apparatus for applying labels to bottles is shown in US 2004/0123955 A1 and to containers in U.S. Pat. No. 6,796,352 B1.

SUMMARY OF THE INVENTION

The invention comprises a method and apparatus for applying indicia to a curved surface. The surface may have compound curvature, which is reduced to curvature in a single plane. The compound curved surface may be a round container, to which a label is applied. All patents and patent applications cited herein are incorporated herein by reference.

DETAILED DESCRIPTION OF THE INVENTION

Figure 1:
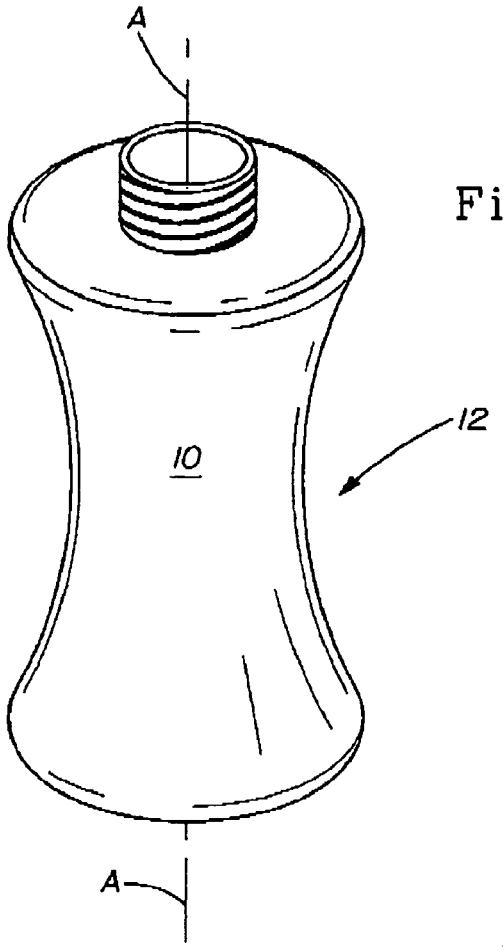
FIG. 1 is a perspective view of a container having a curved surface usable with the present invention.

The invention comprises a method and apparatus 20 for applying indicia 14 to a curved surface 10. The curved surface 10 may be, but is not necessarily, a compound curved surface 10. The compound curved surface 10 may be open or closed about either or both of two or more axes.

The curved surface 10 may be resilient, to allow the surface to deform under pressure and return to its original shape and geometry upon release of the deforming forces. The surface may be of any suitable size, ranging from small, pocket sized objects or smaller, to large billboard sized objects or larger.

The indicia 14 may be applied as a label, as paint, ink, or using any other manner, method or material known in the art. Indicia 14 may be applied cohesively, adhesively, as a heat transfer label, by spraying, by printing, etc. In the heat-transfer labeling process, a label-carrying web may subjected to heat, and the label pressed onto an article with the ink design layer making direct contact with the article. As the paper sheet is subjected to heat, the wax layer begins to melt. This enables the paper sheet to be released from the ink design layer, with a portion of the wax layer being transferred with the ink design layer onto the article and a portion of the wax layer remaining with the paper sheet. After transfer of the design to the article, the paper sheet may be removed, leaving the design affixed to the article and the wax transferred therewith exposed to the environment. The heat-transfer label may further include an adhesive layer (comprising, for example, a polyamide or polyester adhesive) deposited over the ink design to facilitate adhesion of the label onto the surface and/or a protective lacquer layer interposed between the wax release layer and the ink layer. Heat transfer labels may be applied according to the teachings of U.S. Pat. Nos. 6,893,717; 4,548,857; 4,426,422 and 3,616,015, The indicia 14 may comprise a single indicium 14 or plural indicia 14 which may provide aesthetic graphics, information as to trademark or origin, instructions for use, other information relevant to the surface, contents or materials disposed in the container 12 or usable therewith, etc.

Referring to FIG. 1, one suitable execution for the invention is use as a container 12. The container 12 may be fluid tight for holding liquids, or such other materials which are desired to be stored under hygienic conditions. The container 12 may be of any desired volume, ranging from 10 ml or less to 210 liters or more. Suitable containers 12 may range from 0.5 liter to 2 liters for ordinary household use.

If the curved surface 10 is in the form of a container 12, the container 12 may have an open mouth. The mouth may be used to insert and remove contents from the container 12. The mouth may be sealed with a closure, as is known in the art.

The following discussion will be in the context of the container 12 of FIG. 1, although the invention is not so limited. This container 12 is simply an illustrative, nonlimiting example of one execution of a curved surface 10 usable with the claimed invention. However, one of skill will recognize that the discussion below can apply to other forms, shapes, uses and embodiments of curved surface 10 10 as well, and the claimed invention is only limited by the scope of the claims and equivalents thereto.

The container 12 may have a longitudinal axis A-A, may have top and bottom surfaces, either or both of which top and bottom surfaces, if present, may be orthogonal to or skewed relative to the longitudinal axis A-A. The container 12 may be open or closed at either or both of the top and bottom surfaces. The container 12 may be open or closed about the longitudinal axis A-A, may be concave or convex about the longitudinal axis A-A, may be concentric or eccentric about the longitudinal axis A-A, etc.

The container 12 may have an equator. The equator is that line around the container 12 which conceptually and symmetrically divides the container 12 into two equal halves. Containers 12 which are symmetric or asymmetric about the circumferential line at the center of the longitudinal axis A-A and which are asymmetric about the longitudinal axis A-A are contemplated and within the scope of the present invention.

Figure 2:
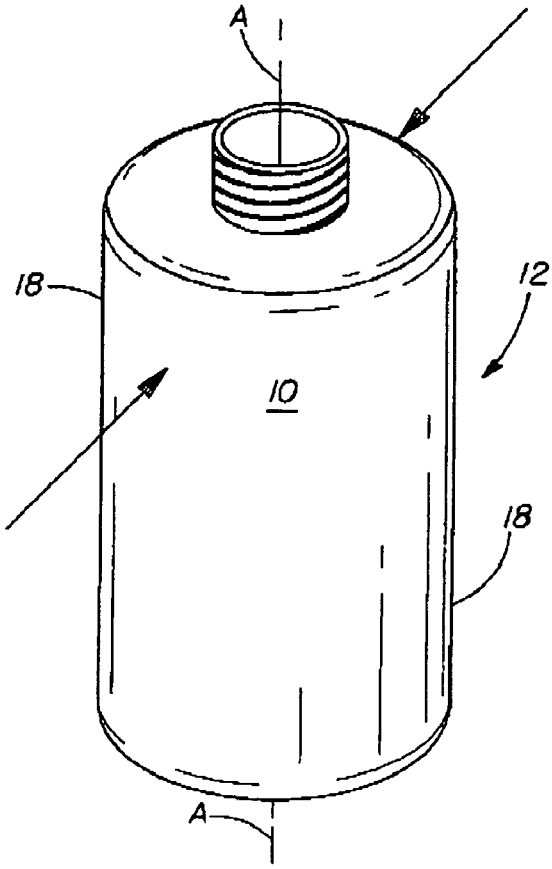
FIG. 2 is the container of FIG. 1 deformed under diametrically applied compressive forces.

Referring to FIG. 2 the container 12 may be subjected to pressure/forces to form a tangent line 18. As used herein a tangent line 18 is a line which is suitable for application of an indicium 14 at that line, using an apparatus 20 and method suitable for that indicium 14 and container 12. The tangent line 18 may be substantially straight. The tangent line 18 may be parallel to the longitudinal axis A-A or may be skewed relative thereto.

The pressure may cause the container 12 to deform so that a substantially straight tangent line 18 occurs at an external surface, where indicia 14 are typically applied so that they may be later seen by a user. The pressure may be applied internally or external to the container 12.

The container 12 may be made of any material which is resiliently deformable. By resiliently deformable it is meant that the material deforms in response to the applied internal or external pressure in a manner sufficient to yield a tangent line 18 to which the indicia 14 may be applied. After the applied pressure is released, the material returns to its original shape/geometry or such other shape/geometry as may be desired for the end use. One of skill will recognize that the material properties may be tailored to the specific geometry of the desired curved surface 10. Certain material/geometry combinations may be suitable, while other combinations involving the same material or geometry may be infeasible.

Suitable materials include thermoplastic materials. The materials may have isotropic or anisotropic properties. If the properties are anisotropic, the anisotropic properties may be tailored to the different radii of curvature, if present, of the compound curves. Suitable exemplary materials include biaxially oriented polypropylene, PE, PET, etc. and other materials commonly used in blow molding, injection molding, thermoforming, etc.

Figure 3:
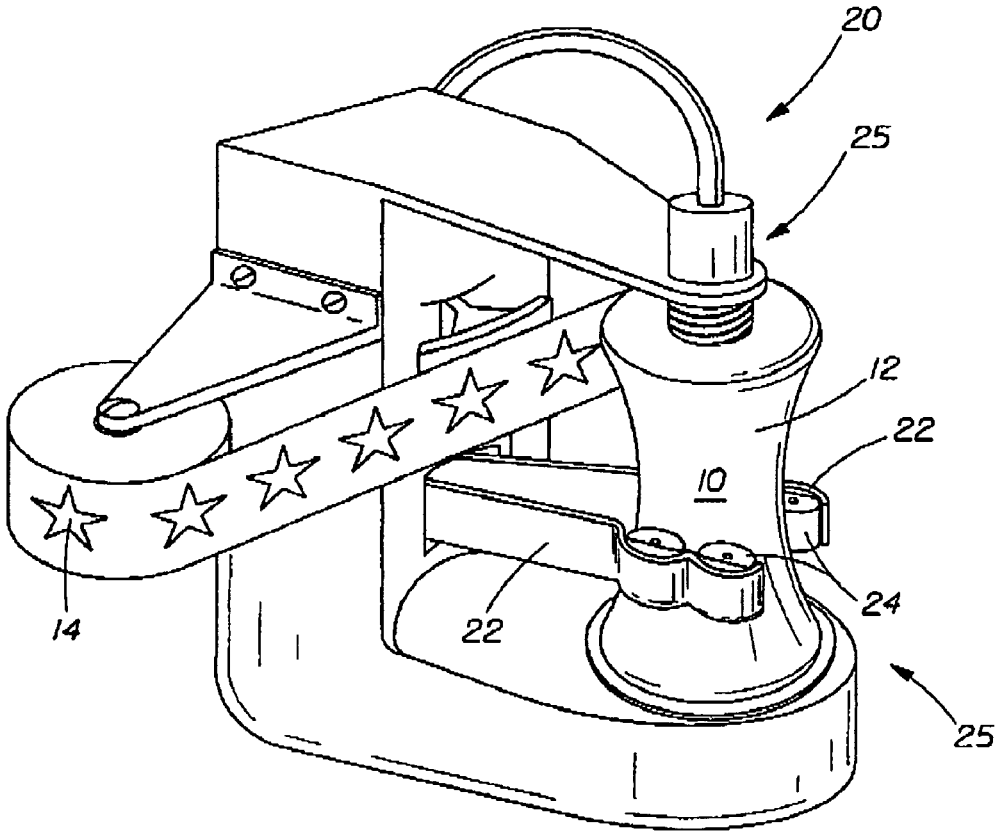
FIG. 3 is a perspective view of one embodiment of an apparatus for applying a label to the container of FIG. 1 and utilizing arms for compression of the curved surface.

Referring to FIG. 3, one exemplary apparatus 20 and process for applying indicia 14 according to the present invention utilizes external compression forces to elastically deform the container 12 to yield a generally straight tangent line 18. Such an apparatus 20 has opposed members 22 which may apply compressive forces to the container 12. The compressive forces may be diametrically applied or applied at any angle which causes deformation of the container 12 suitable to yield a tangent line 18.

Each member 22 may be biased towards the other or one member 22 may be rigid and the other member 22 biased towards the rigid member 22. The member(s) 22 may be articulably biased or biased in a kinematic translation mode. The members 22 may be biased using spring force(s), hydraulic forces, pneumatic forces, cams, or magnetism, electrically generated forces, accelerative forces, or simply using dead weight, as is well known to one of ordinary skill.

Either or both members 22 may have one or more rollers 24, as shown. The rollers 24 may allow the container 12 to rotate about the longitudinal axis A-A. Such rotation may subtend 360 degrees or greater/lesser arcs, as desired. One or more of the rollers 24 may be driven in known manner to provide the rotational force to the container 12. Alternatively or additionally, one or more of the rollers 24 may be idlers, to allow the container 12 to rotate under the application of separate rotational force(s).

Separate rotational force(s) may be applied to the container 12 at one or more locations 25 spaced apart from the members 22. For example, the neck, also referred to in the art as the finish, may be used as the point of application of the rotational force(s). Alternatively or additionally, rotational force(s) may be applied to the base of the container 12.

Referring back to FIGS. 1-2, as the container 12 is subjected to opposed compressive forces, the container 12 may deform so that a tangent line 18 is formed. The tangent line 18 may be formed so that it is generally perpendicular to the line of compression. The amount of compression may be applied so that the tangent line 18 resulting therefrom is generally straight. If the container 12 is hourglass shaped prior to application of the deforming forces, and too little force is applied, the container 12 will remain concave shaped, although to a lesser amount. If too much force is applied, the opposed sides of the container 12 will bow past a straight tangent line 18 and become convex. The amount of compressive force may be adjusted to produce a straight tangent line 18.

Referring back to FIG. 3, two members 22 exerting compressive force about 180 degrees apart are illustrated in the figures. But the invention is not so limited. Three members 22 spaced 120 degrees apart, four members 22 spaced 90 degrees apart, etc. or plural irregularly spaced members 22 may be utilized. It is believed that two opposed members 22 will likewise yield two tangent lines 18 therebetween, three members 22 would yield three tangent lines 18 therebetween, etc.

The tangent line 18 may be disposed in a static position on the container 12 while the container 12 is subjected to the deformation forces. Alternatively, and as discussed herein, the tangent line 18 may be dynamic, moving around the container 12 as the container 12 rotates within the apparatus 20. Alternatively, the container 12 may remain stationary, and the members 22 rotate around the longitudinal axis A-A of the container 12 to allow the tangent line(s) 18 to be circumferentially displaced around the container 12 as much as desired. Any apparatus 20 and process which provide for relative movement between the tangent line 18 and the apparatus 20 is suitable.

The indicia 14 may be applied to the container 12 at the tangent line 18. More particularly, the indicia 14 may be applied tangent to the tangent line 18. More particularly the indicia 14 may be applied generally perpendicular to the tangent line 18 and in line with the direction of application of the compressive forces. Of course, plural like or different indicia 14 may be applied at different positions on the tangent line 18.

While the figures illustrate applying indicia 14 to only a single tangent line 18, the invention is not so limited. One or more indicia 14 may be applied at each tangent line 18 formed by the compressive forces.

Figure 4A:
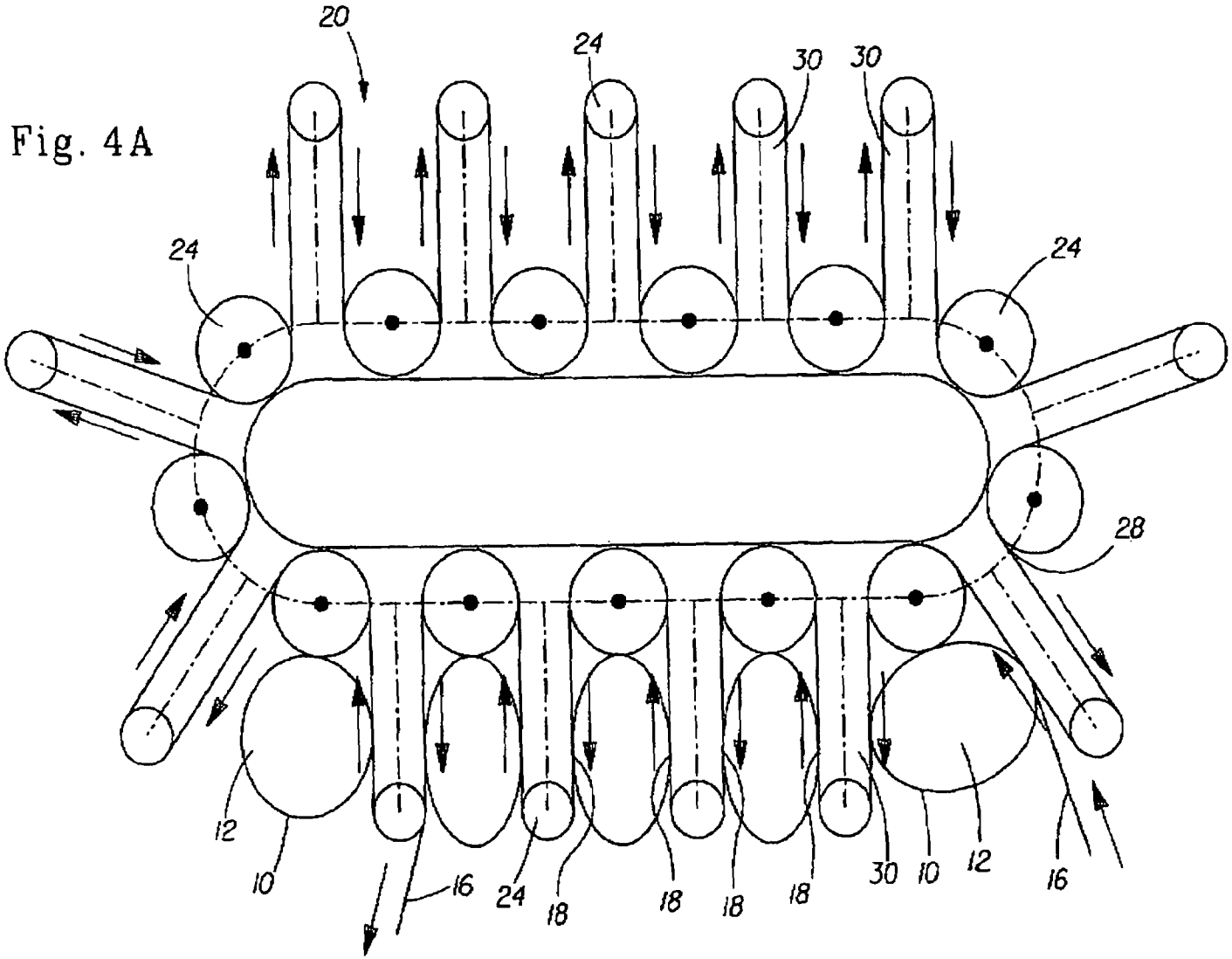
FIGS. 4A, 4B, and 4C are top plan views of three other embodiments of apparatus for applying a label to the container of FIG. 1 and utilizing belts for compression of the curved surface.
Figure 4B:
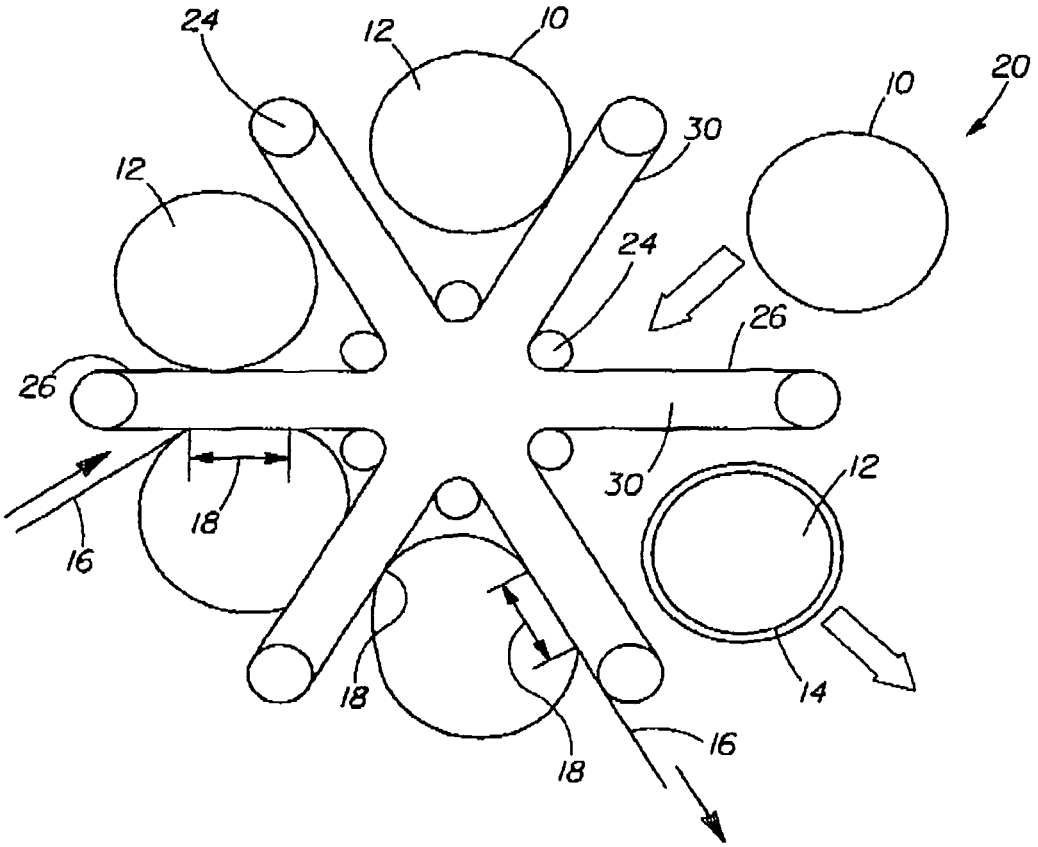
Figure 4C:
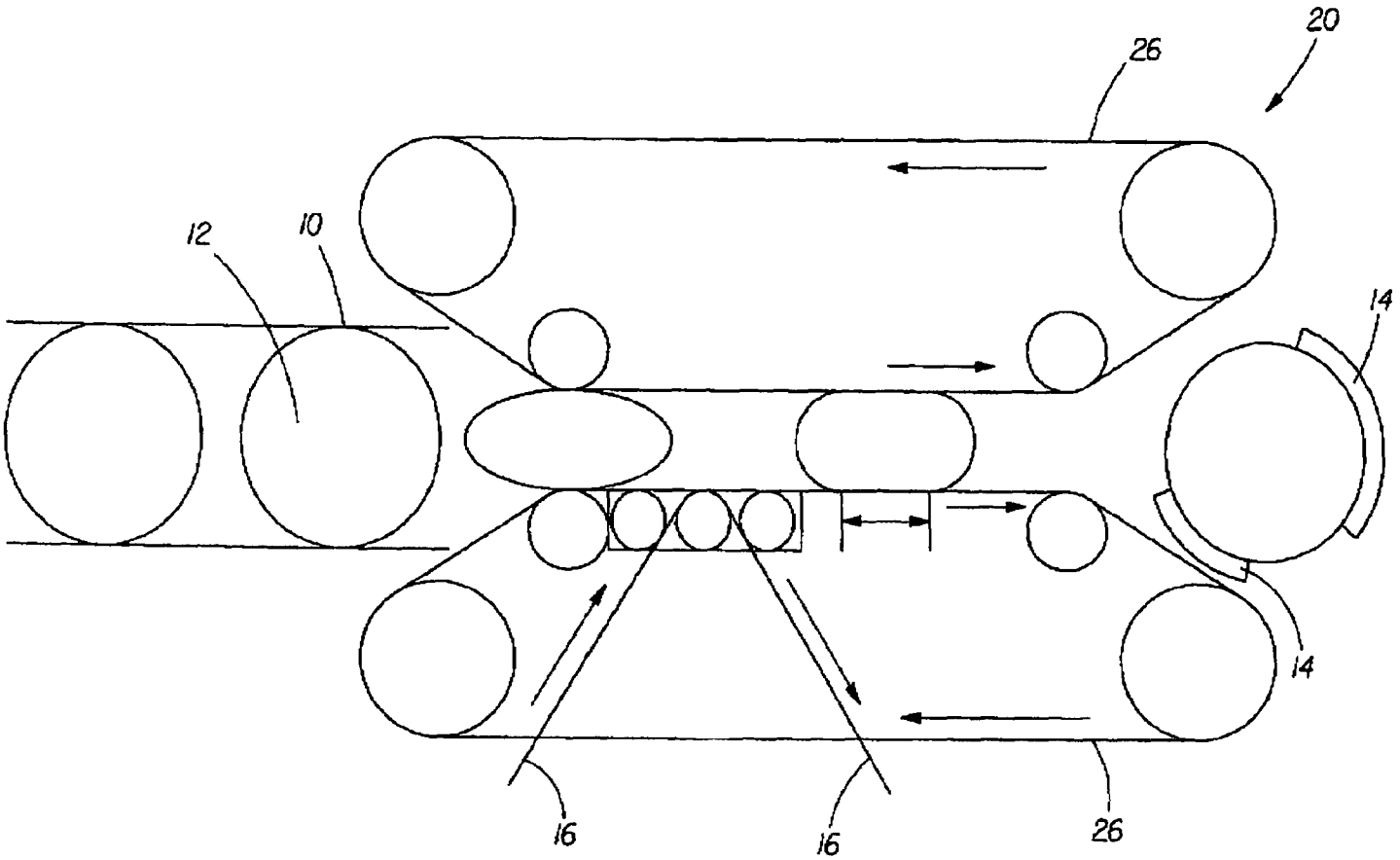

Referring to FIGS. 4A, 4B, and 4C, the members 22 may be provided in the forms of belts 26 which compress one or more containers 12 therebetween. The belts 26 may move in a closed loop and elastically deform one or more containers 12 therebetween in compression, to yield one or more tangent lines 18 on that container 12. The indicia 14 may be applied to the container 12 between the tangent lines 18 and that belt 26. The belts 26 provide for relative motion between the line(s) of compression and the compressed portions of the container 12.

The embodiment of FIG. 4A utilizes a plurality of movable arms 30 with a belt 26 around one or more of the arms 30. The proximal end of each arm 30 may be joined to a track 28 and move around the track 28. The distal end of each arm 30 may have a roller 24 thereon. The roller 24 may be a drive roller 24 or a driven roller 24. The arms 30 may be separated by drive rollers 24 or driven rollers 24 juxtaposed with the track 28. A belt 26 may interconnect each arm 30 and the track 28.

The belt 26 may be driven by known equipment to traverse the entire track 28 and each arm. The proximal end of each arm 30 may pivot, to allow such arm 30 to move around the periphery of the track 28. While a generally straight track 28 is shown, the invention is not so limited. The track 28 may be curved, form a closed loop, etc.

As the arms 30 are separated, as may occur at the end of the track 28 for example, a container 12 may be inserted between two adjacent arms 30, using external hardware (not shown) as is known in the art. The container 12 may also be inserted between the arms 30 at any other suitable location 25, or plural containers 12 may be inserted at different locations. As the arms 30 travel towards the center of the track 28, the arms 30 may become closer together. This may reduce the space between adjacent arms 30 compressing the container 12 therebetween. Such compression may yield a tangent line 18 at each point where the container 12 contacts the belt 26.

The container 12 may be removed from the apparatus 20 at any suitable location after the desired indicium(a) 14 is/are applied. Of course, it will be apparent that other processes may occur while the container 12 is in the apparatus 20 as well. For example, the container 12 may have contents added thereto, may have curing energy applied thereto, may be washed, etc. while in the apparatus 20. The container 12 may be removed from the apparatus 20 at any suitable location, such as either end of the apparatus 20.

Movement of the belt 26 may result in concomitant rotation of the container 12. The indicia 14 may be interposed between the tangent line 18 of the container 12 and the belt 26, and applied to the container 12 at this tangent line 18.

FIG. 4B shows a simplified version of the apparatus 20 of FIG. 1. This apparatus 20 may have a generally star shape. One or more containers 12 may inserted into the apparatus 20 in known manner using external equipment (not shown). The belt 26 rotates around the star shape elastically deforming the container 12 to yield tangent lines 18 between the points of compression on the belts 26. The indicia 14 may be applied at such tangent lines 18.

FIGS. 4B-4C illustrate tangent lines 18 which have a discernable width, taken perpendicular to the longitudinal axis A-A of the container 12. The tangent lines 18 according to the present invention may be of very limited width, as occurs in geometry, which width is sufficient to allow application of an indicium 14 at the tangent line 18. Alternatively, the tangent line 18 may be thought of being comprised of plural, parallel lines, which lines may form the discernable width in the aggregate.

FIG. 4C shows an apparatus 20 having two opposed belts 26 defining a lane therebetween. The lane may have an inlet and an outlet. The container 12 is fed into the inlet of the lane, where it is elastically deformed in compression therebetween by the belts 26. Such deformation may result in a tangent line 18 at the contact with each belt 26.

One or more indicia 14 may be applied between each belt 26 and the corresponding tangent line 18, or a single indicium 14 may be applied at one belt 26. The indicia 14 may be brought to the container 12 or vice versa. If the indicia 14 are brought to the container 12, they may be applied from a carrier.

The belts 26 may move at matched speed or may move at different speeds. If the belts 26 move at the same speed, the container 12 may be rotated by an external drive, as described above. If the belts 26 move at different speeds, such speed differential may cause rotation of the container 12.

The belts 26 may be matched or different in their longitudinal dimension and position (taken perpendicular to the plane of the figure). If the belts 26 are not longitudinally matched, different tangent lines 18 may result. Such different tangent lines 18 may be used to apply different indicia 14. The belts 26 may be mutually parallel, as shown or may converge/diverge between the inlet and exit, provided that sufficient tangent lines 18 occur to allow application of the desired indicia 14. One of skill will recognize that a series of rollers 24 may be used in place of either or both belts 26.

Figure 5A:
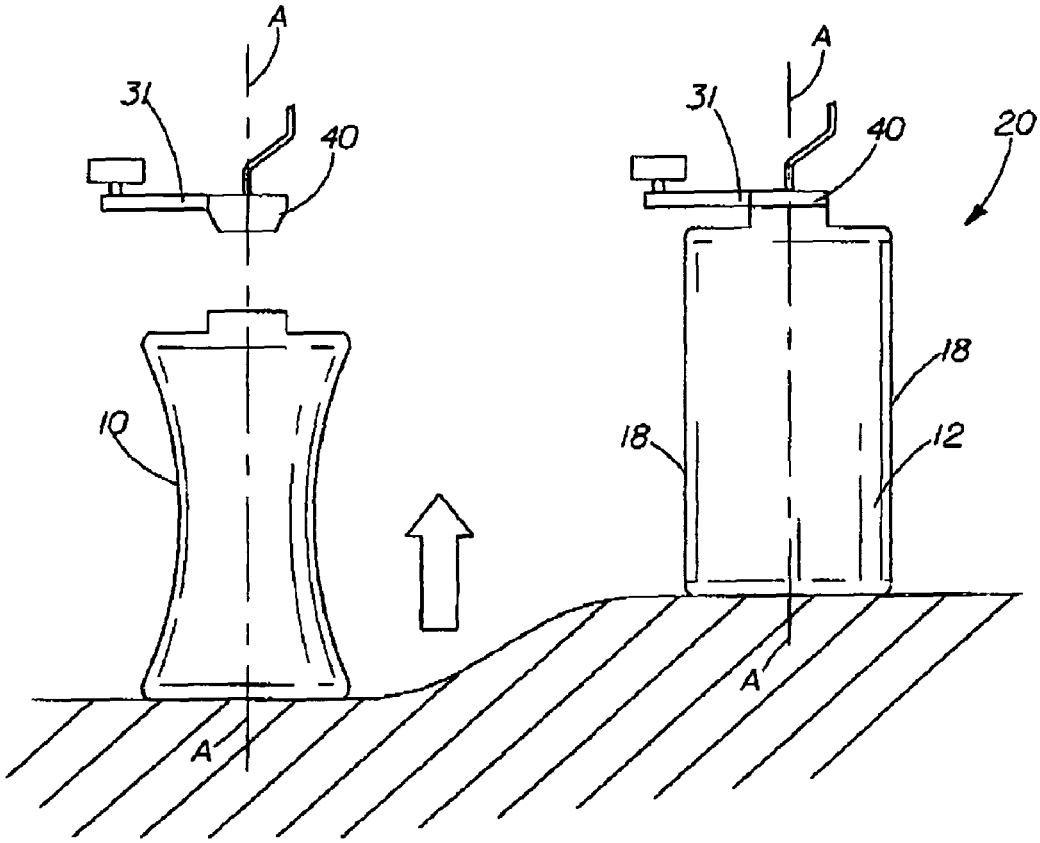
FIGS. 5A and 5B are side elevational and top plan views, respectively, of another embodiment of an apparatus for applying a label to the container of FIG. 1 and utilizing internal pressurization for deformation of the curved surface.
Figure 5B:
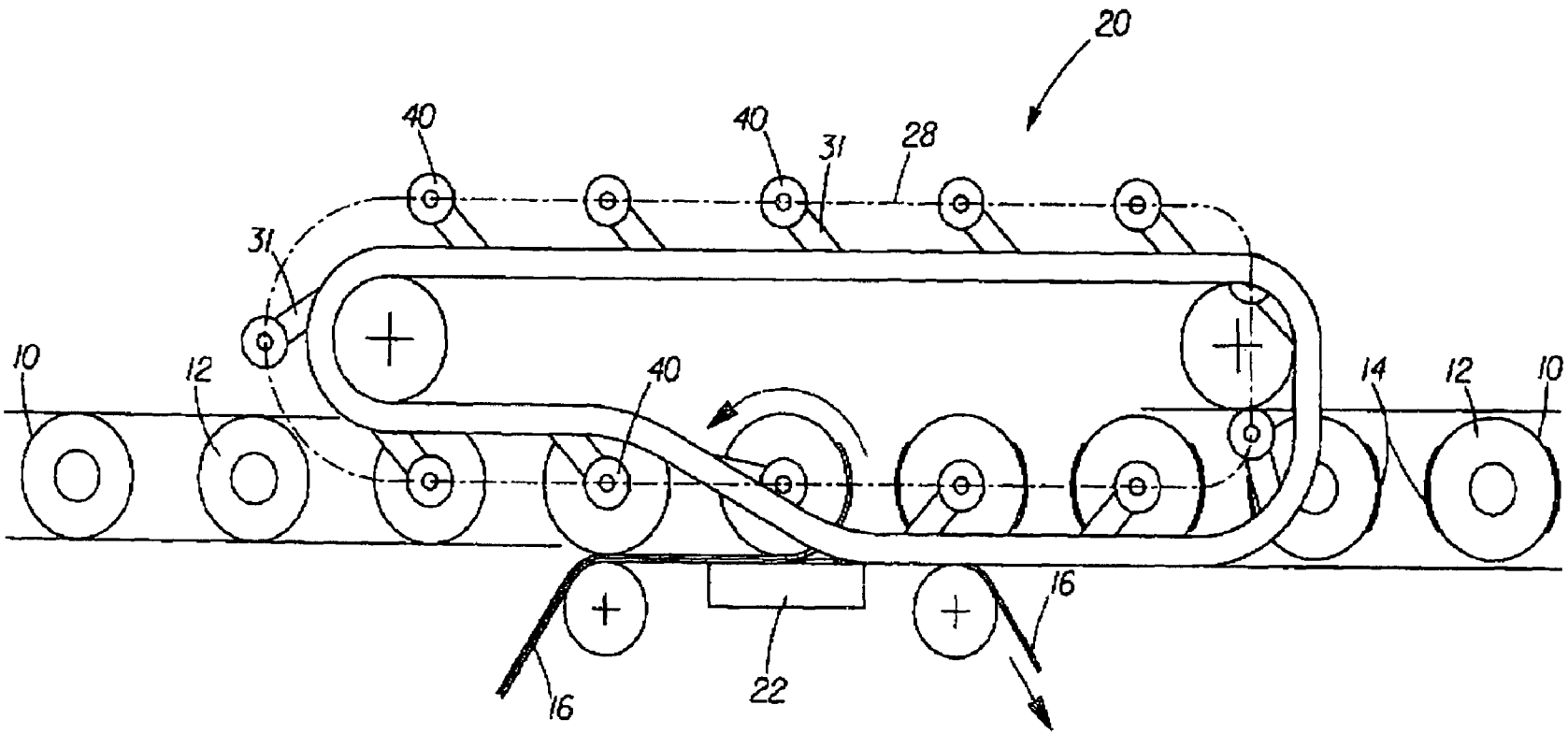

Referring to FIGS. 5A and 5B, another embodiment of an apparatus 20 is shown. This embodiment employs external pressurization of the container 12 to elastically deform the container 12, and yield a tangent line 18 in response to such deformation.

This apparatus 20 may utilize a movable track to dispose the container 12 between a swing arm 31 and a fixed member 22. The fixed member 22 may be flat, may be generally planar, may be a rigid wall, and may be generally parallel to the longitudinal axis A-A of the container 12, as shown. The swing arm 31 may move towards and away from the fixed member 22.

Inflation of the container 12 may cause the tangent line 18 to occur. Inflation may occur in response to internal pressurization of the container 12. Internal pressurization may be accomplished by a plug 40 which is inserted into the open mouth of the container 12 to form a seal. The plug 40 may be connected to a fluid source, such as a gas or liquid. The connection may be accomplished by a flexible hose, tubing or other line between the plug 40 and a reservoir, air compressor or other source of pressurizing medium.

Upon inserting and retaining the plug 40 into the mouth of the container 12, the container 12 may be pressurized by releasing the fluid from the reservoir, air compressor or other supply. The internal pressurization may be applied in an amount sufficient to deform the container 12 to produce generally straight sidewalls. This arrangement may provide the advantage that the container 12 inflates from a convex or concave geometry to a cylindrical shape. Such a cylindrical shape would have a plurality of tangent lines 18 extending throughout the entire circumference of the cylinder. Having plural tangent lines 18 may provide more flexibility in applying the indicia 14 to the container 12.

If desired, the internal pressurization may be assisted by a bladder (not shown). The bladder may be deflated and inserted into the container 12 with the plug 40. Upon inflating, the bladder may expand and deform the sides of the container 12 to form one or more tangent lines 18. The geometry of the bladder may be tailored to the geometry of the container 12 to more advantageously cause deformation which achieves the desired tangent line(s) 18.

For example, if it is only desired to deform a portion of the container 12 to provide a tangent line 18 in that portion of the container 12, the bladder may be constructed with a geometry to assist in allowing this to occur. Depending upon the desired execution, one may wish to apply the indicia 14 to only a particular longitudinal portion of the container 12, e.g. the center third or top half of the container 12 or one may wish to apply the indicia 14 to only a particular circumferential portion of the container 12, e.g. the front half or to any 60 degree sector of the container 12.

The tangent line 18 may occur at the fixed member 22 and may be parallel thereto and coincident the surface of the fixed member 22. The indicia 14 may be interposed between the fixed member 22 and the tangent line 18 of the container 12 juxtaposed therewith. Friction between the fixed member 22 and the container 12 may cause the container 12 to rotate about its longitudinal axis A-A, while maintaining contact with and sliding along the fixed member 22. Alternatively, rotation may be provided by a separate drive, as described above.

Such rotation of the container 12 may cause the tangent line 18 to similarly move partially or completely around the circumference of the container 12. The indicia 14 may be applied coincident the tangent line 18 throughout such rotation.

After the indicia 14 are applied to the container 12, the internal pressure may be completely or partially released. This allows the container 12 to return to its original geometry or to any other geometry between the original geometry and that geometry which yields the tangent line 18 used for application of the indicia 14. The bladder, if present may be deflated and then withdrawn from the container 12.

The swing arm 31 may move around a track of any suitable geometry. Plural swing arms 30 may be utilized. Each swing arm 31 may be fitted with one or more plugs 40 to intercept a like number of containers 12. Alternatively, different plugs 40 may be used with different sizes of container 12 openings.

The container 12 may move on a dedicated track, under a separate drive. The swing arm 31 may intercept a container 12 as it moves towards the rigid member 22. When the swing arm 31 intercepts the container 12, the plug 40 may be inserted into the container 12 and the internal pressurization process described above may be employed.

Figure 6A:
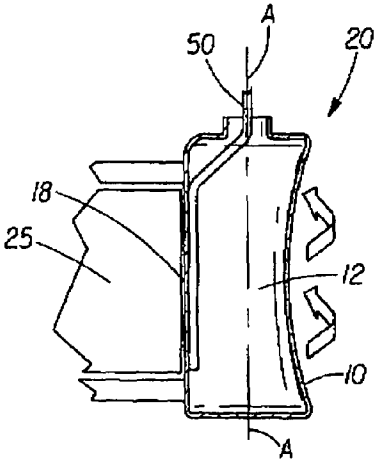
FIGS. 6A and 6B are side elevational and top plan views, respectively, of another embodiment of an apparatus for applying a label to the container of FIG. 1 and utilizing an eccentrically disposed mandrel for deformation of the curved surface.
Figure 6B:
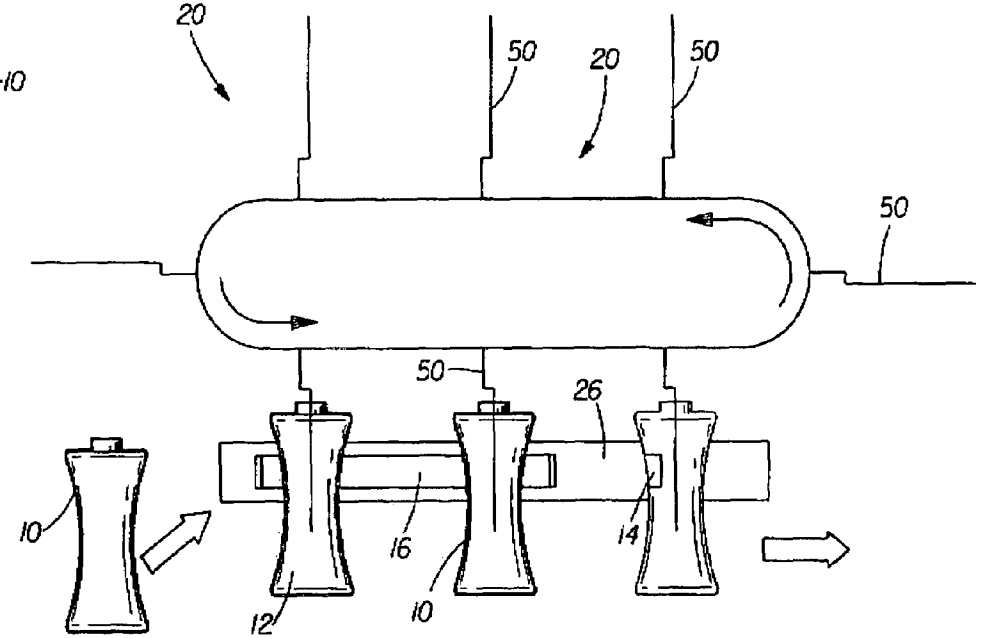
Figure 7A:
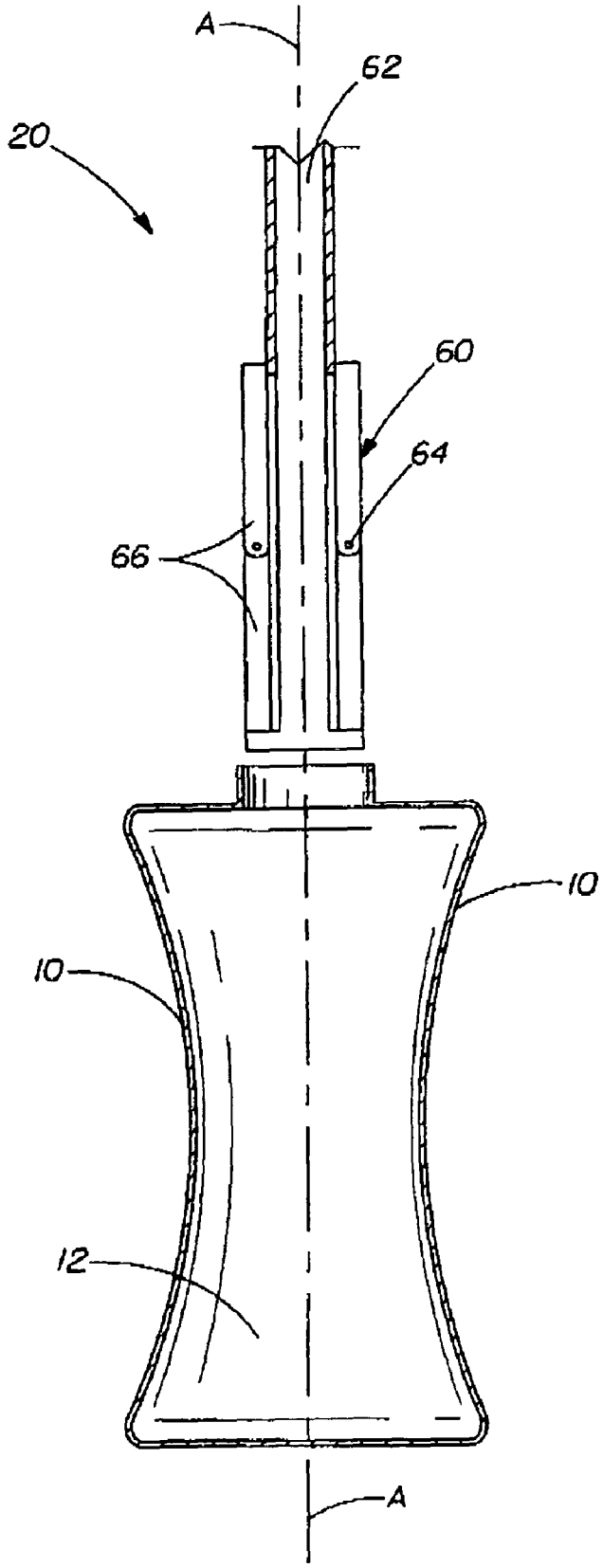
FIGS. 7A, 7B, 7C and 7D are schematic side elevational views showing, in series, another embodiment of an apparatus for applying deforming forces to the inside of the container and using a radially expanding mechanism inserted into a container.
Figure 7B:
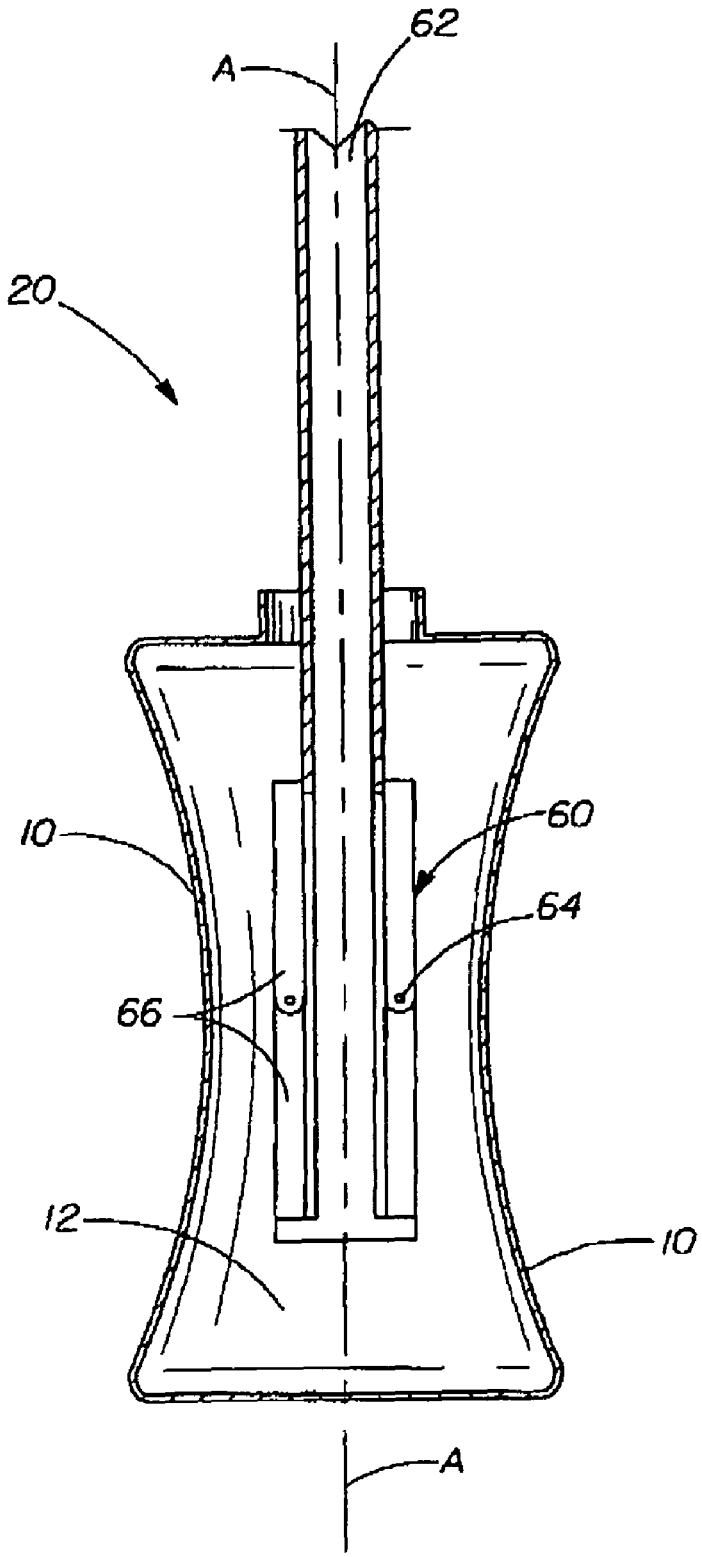
Figure 7C:
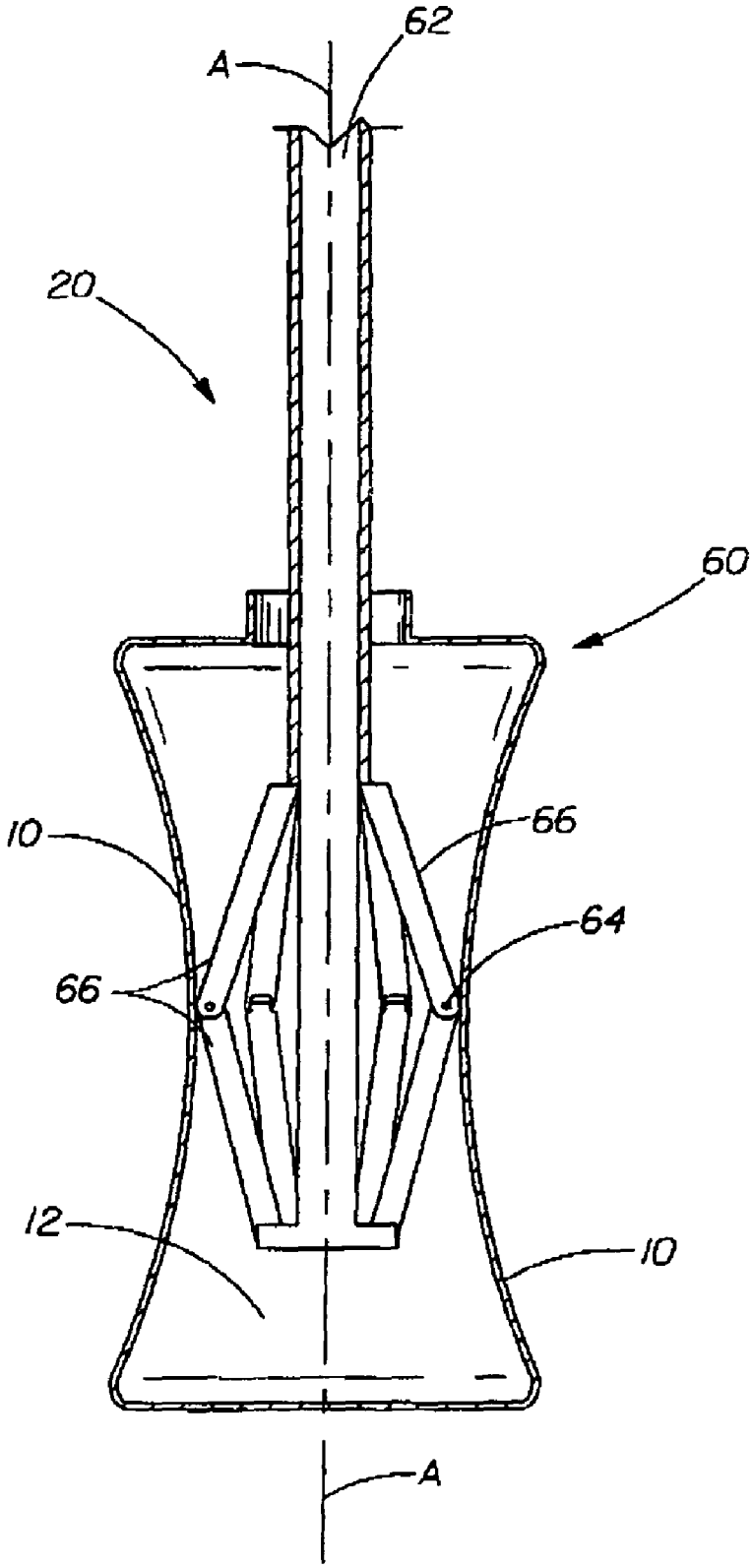
Figure 7D:
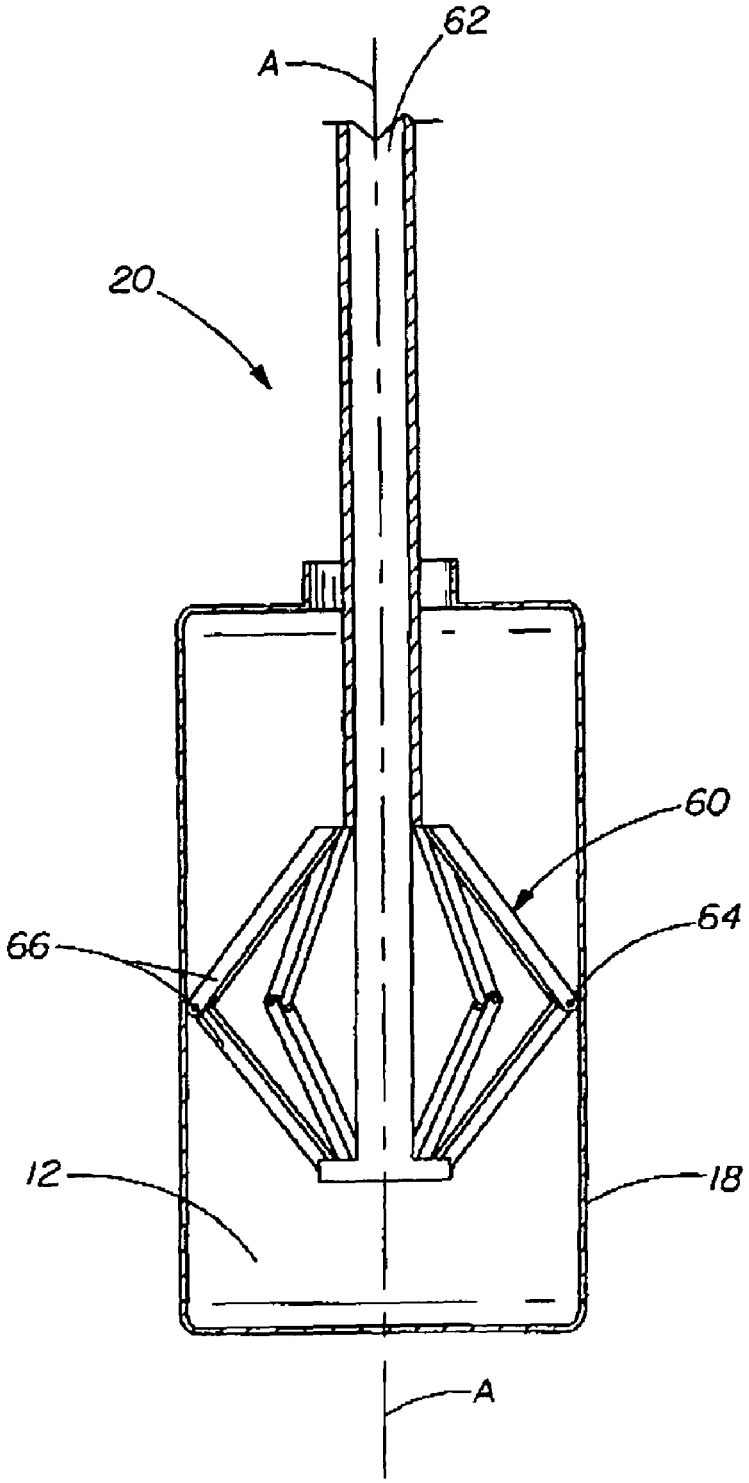

Referring to FIGS. 6A and 6B, another apparatus 20 is shown which elastically deforms the container 12 from the inside. This apparatus 20, however, does not utilize the internal pressurization described above. Instead, this apparatus 20 utilizes a mandrel 50 which is inserted into the container 12. The mandrel 50 may be offset from the center of the container 12, and more particularly may be radially offset from the longitudinal axis A-A of the container 12. Such an offset may be used to have the mandrel 50 contact the internal side wall of the container 12. The mandrel 50 may be generally parallel the longitudinal axis A-A of the container 12.

The mandrel 50 may compress the sidewall of the container 12 between the mandrel 50 and a rigid member 22. The rigid member 22 may be fixed, which may cause the container 12 to rotate about its longitudinal axis A-A as it is moved within the apparatus 20. Alternatively, the rigid member 22 may be movable. If movable, the rigid member 22 may move at the same speed as, and may even drive, the container 12. The belts 26 may move at constant or variable speed, as desired to control the rate of bottle rotation. Suitable rigid members 22 may be drive belts 26 or driven belts 26. Such belts 26 may be backed by stationary walls for support, as is known in the art.

The mandrel 50 may compress the sidewall between the mandrel 50 and the rigid member 22 forming a tangent line 18 therebetween. The indicia 14 may be interposed between the container 12 and this tangent. The indicia 14 may then be applied to the container 12, as described above.

While an apparatus 20 having a single mandrel 50 for each container 12 and a single rigid member 22 is illustrated, the invention is not so limited. Plural mandrels 50 and/or plural rigid members 22 may be utilized with each container 12. For example, two mandrels 50 may be inserted into the container 12 and may disposed 180 degrees apart. Likewise, two movable rigid members 22 may be utilized, one juxtaposed with each mandrel 50. The mandrels 50 may deform the container 12 into two tangent lines 18, one between that mandrel 50 and a respective rigid surface. Of course, one of skill will recognize that three or more mandrels 50/rigid members 22, equally or unequally circumferentially spaced about the container and of equal or unequal longitudinal dimension and/or position may be utilized.

The mandrel 50 may extend throughout substantially all of or only any desired portion of the container 12. The mandrel 50 will likewise deform only that portion of the container 12 into a tangent line 18 which is generally interposed between the mandrel 50 and the rigid surface. This allows selective placement of the indicia 14 at the desired portion or to substantially all of the container 12. Indicia 14 may be applied to the container 12 at the position of the external surface corresponding to one or more tangent lines 18 formed by the mandrel(s) 50.

Furthermore, if it is desired to apply the indicia 14 to the inside surface of the container 12, the mandrel 50 may be utilized to print the indicia 14 onto the inner surface of the container 12. If the container 12 is transparent, the indicia 14 may be visible through the container 12 wall. If the container 12 is opaque, the indicia 14 may provide a functional benefit to the inside of the container 12.

Referring to FIGS. 7A, 7B, 7C and 7D, a radially expanding mechanism 60 is shown. The mechanism is inserted into the container 12. The mechanism may use a central rod 62 which holds a scissors jack. The scissors jack is longitudinally collapsed at its hinges 64. Since the length of any leg 66 of the scissor jack is constant, the longitudinal collapse results in radial expansion of the leg 66 at the hinge 64.

Such radial expansion may cause the leg 66/hinge 64 to contact the interior wall of the container 12. By applying force to the wall at the contact point, the wall may deform outwardly, creating a tangent line 18. Indicia 14 may be applied to the curved surface 10 at this tangent line 18.

If desired, rotational forces may be applied to the container 12 through rotation of the central rod 62. This allows the container 12 to rotate through any desired angle, including angles less than, greater than and equal to 360 degrees. Such rotation allows the indicia 14 to be applied to any desired portion of, or all of, the container 12.

Any suitable number of legs 66, including a plurality of equally or unequally circumferentially spaced legs 66, of equal or unequal longitudinal extent and position, may be utilized. Such flexibility in the mechanism 60 allows the scissors jack to be tailored to the geometry of the bottle 12 and curved surface 10 under consideration. While a mechanism 60 having bifurcated legs 66 connected by a single, central hinge 64 is illustrated, the invention is not so limited. More than two legs 66 utilizing plural hinges 64 in a given linkage may be utilized.

After the indicia 14 are applied, the legs 66 are collapsed to a lesser diameter. This allows the mechanism 60 to retract the assembly from the container 12 by longitudinal withdrawal of the central rod 62.

Of course, one of skill will recognize the hardware and embodiments described above are not necessarily mutually exclusive. For example, external compression may be used with internal pressurization. Internal pressurization may be used with an internal mandrel 50. An internal mandrel 50 may be used with external diametric compression. Or all three embodiments and hardware may be used collectively as well as individually. While the figures illustrate containers 12 having a vertically oriented major axis, the invention is not so limited. The containers 12 may have a horizontally oriented major axis, a major axis oriented at any angle therebetween, a major axis which changes during the process/apparatus 20 described herein or no major axis at all.

All such variations and executions are within the scope of the claims below.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for applying an indicium to a closed curved surface, said apparatus comprising:

pressure applying hardware for applying internal or external pressure to the closed curved surface, whereby application of said pressure causes said curved surface to form a straight tangent line, said straight tangent line being disposed at a first circumferential position;

a drive for rotating said closed surface about an axis, whereby said tangent line can move to a second circumferential position spaced apart from said first circumferential position; and indicium applying hardware for applying an indicium to said curved surface at a position juxtaposed with said tangent line at said first position and said second position, said indicium applying hardware being spaced apart from straight tangent line at said first circumferential position, whereby said indicium is not applied at a position coincident said pressure applying hardware.

2. An apparatus according to claim 1 wherein said pressure applying hardware applies external forces in a first direction to diametrically deform said closed curved surface.

3. An apparatus according to claim 2 wherein said straight tangent line is disposed generally perpendicular to said first direction.

4. An apparatus according to claim 3 wherein said hardware comprises two members and said curved surface is compressed between said members.

5. An apparatus according to claim 4 wherein said members comprise spaced apart parallel belts.

6. An apparatus according to claim 3 comprising pressure applying hardware which form plural tangent lines and further comprising plural indicium applying hardware for applying indicia at each said tangent line.

* * * * *